US006043732A

United States Patent [19]

Shulman

[11] Patent Number: 6,043,732

[45] Date of Patent: Mar. 28, 2000

[54] VACUUM ACTIVATED SWITCH AND CONTAINER

[76] Inventor: Burt Shulman, 5 D. Van Horn Cir., Beacon, N.Y. 12500

[21] Appl. No.: 09/023,138

[22] Filed: Feb. 12, 1998

Related U.S. Application Data

[60] Provisional application No. 60/038,002, Feb. 14, 1997.

[51] Int. Cl.[7] ..... G08B 3/00

[52] U.S. Cl. ..... 340/328; 340/326; 340/691.1; 239/17; 369/63

[58] Field of Search ..... 340/328, 326, 340/626, 327, 691.1, 691.2, 692, 404.1, 404.3; 362/101, 96; 220/705; 239/17, 18; 369/63, 68; 206/217; 84/94.2; 446/188, 202, 213

[56] References Cited

U.S. PATENT DOCUMENTS

| | | | |
|---|---|---|---|
| 3,122,959 | 3/1964 | Barr | 84/94 |
| 3,879,885 | 4/1975 | Fabricant | 46/44 |
| 4,121,835 | 10/1978 | Garabedian | 274/1 R |
| 4,631,715 | 12/1986 | Hoover | 369/68 |
| 4,699,318 | 10/1987 | Donatello et al. | 239/33 |
| 4,765,465 | 8/1988 | Yamada et al. | 206/217 |
| 5,160,087 | 11/1992 | Mandell | 239/33 |
| 5,213,234 | 5/1993 | Stefanopoulos | 222/78 |
| 5,344,034 | 9/1994 | Eagan | 215/11.1 |
| 5,785,406 | 7/1998 | Lee | 362/96 |

*Primary Examiner*—Daryl Pope
*Attorney, Agent, or Firm*—Gifford, Krass, Groh, Sprinkle & Anderson & Citkowski, P.C.

[57] ABSTRACT

A vacuum activated switch for use in or with a drinking container and straw. The switch includes a flexible membrane, a traveling contact which rests on the flexible membrane, and a fixed contact which is mounted on an integrated circuit board. Suction upon the straw creates a partial vacuum, causing the membrane to deflect, thereby carrying with it the traveling contact. This motion will cause the traveling contact to come into electrical contact with the fixed contact, thereby completing a circuit. The integrated circuit board is programmed to initiate an action upon completion of the circuit, such as, preferably, the production of a preselected melody or other sound.

18 Claims, 3 Drawing Sheets

VACUUM ACTIVATED SWITCH AND CONTAINER

This application is based on provisional Application No. 60/038,002, filed Feb. 14, 1997 for a musical drinking straw, the disclosure of which is incorporated herein by reference.

BACKGROUND OF THE INVENTION

Novelty drinking straws are a perennially popular item, particularly for children. A number of such straws have been developed which include an audio component. That is, the straw is capable of making or reproducing a pleasant or humorous sound. For example, U.S. Pat. No. 3,122,959 discloses a conventional music box mounted around a drinking straw. The music box includes a crank so that it may be operated by turning the crank, either in conjunction with using the straw to sip liquids, or simply by itself.

U.S. Pat. Nos. 4,121,835 and 4,631,715 both disclose drinking straws which have a recorded soundtrack formed along their external surfaces. When either of these straws is moved through an opening in a resilient container lid, the recording on the sound is reproduced. The pitch and speed of the reproduced sound will vary depending on how the straw is manipulated. In the case of the '715 patent, the straw is pushed through cross slits in the container lid so as to produce a sharper point which vibrates against the soundtrack on the straw. Since these straws must be pushed up and down through the container lid to produce a sound, it is difficult to perform such manipulation while the straw is otherwise in use.

It would be advantageous to have a straw which is capable of reproducing a prerecorded sound simply by the act of sipping beverage through the straw. It would also be advantageous to have such a straw wherein the sound is producible while the straw is in use.

It would be further advantageous to have a straw including a vacuum switch which is activated by suction on the straw to cause the occurrence of a novelty action, such as playing prerecorded music, activating a light, moving lightweight objects, or releasing mechanical motion in a windup toy.

It would also be advantageous to have a novelty container in combination with such a drinking straw in which the slight vacuum created by sipping from the straw serves to move an electronic contact onto a switch connected to a battery powered component to initiate an action, such as the playing of a prerecorded melody.

SUMMARY OF THE INVENTION

Disclosed herein is a novelty drinking straw which uses the vacuum pressure created by sipping to switch on an electronic component. In one embodiment, a container is provided which includes a drinking vessel which is sealed by a cap containing the electronic components and vacuum triggered switch, as well as a straw. The straw can either be molded of one piece with the container, or provided as a separate piece and inserted into a hole in either the cap or container. Alternatively, the straw may include the switch components self-contained in a T-fitting. This embodiment may be used with an open container.

In a preferred embodiment of the present invention, the vacuum triggered switch includes a flexible or semirigid membrane mounted around its perimeter to a rigid surface. For example, the rigid surface may cover the top of the drinking vessel, and the membrane be mounted to one of its surfaces. The rigid surface has an aperture formed through it. When a pressure differential is applied across the membrane, such as occurs when liquid is sipped from a closed container via the drinking straw, the membrane moves in the direction of lower pressure. This movement causes an electrically conductive contact in physical contact with the membrane, to move from a first position, where it is spaced from a stationary conductive member, to a second position wherein it is in contact with said stationary conductive member.

The moving contact and stationary conductive member are connected to an integrated circuit which, when electrical connection is made by the contact with the conductive member, completes the circuit to initiate an action such as, for example, a sound or a musical melody emitted through a speaker element. The integrated circuit and speaker element are mounted to the rigid surface of the container on an opposite side from the flexible membrane. A cap portion covers the integrated circuit and is sealed to the rigid member.

Additionally, the contact member may be mechanically connected to the membrane. The aperture in the rigid surface, which allows atmospheric pressure to contact the back of the membrane, is also a convenient passageway through which the mechanical members, referred to above, can contact the back of the membrane.

In an alternative embodiment, the flexible or semirigid membrane is provided as a bellows with accordion pleated walls. By using a bellows configuration, the membrane can have a relatively small outside diameter yet result in a relatively larger displacement than would be the case with a simple flat membrane.

In other embodiments of the container of the present invention, activation of the switch by sipping through the straw as described above closes the circuit to initiate an action other than the playing of a prerecorded sound or musical melody. For example, one or more lights could be activated to flash on or off in a particular predetermined sequence. Another example of such action would be causing a figure to twirl around or dance, animating the mouth and eyes of a molded human or animal head, or similar novelty actions.

DETAILED DESCRIPTION OF THE PREFERRED EMBODIMENT

Figure 2:
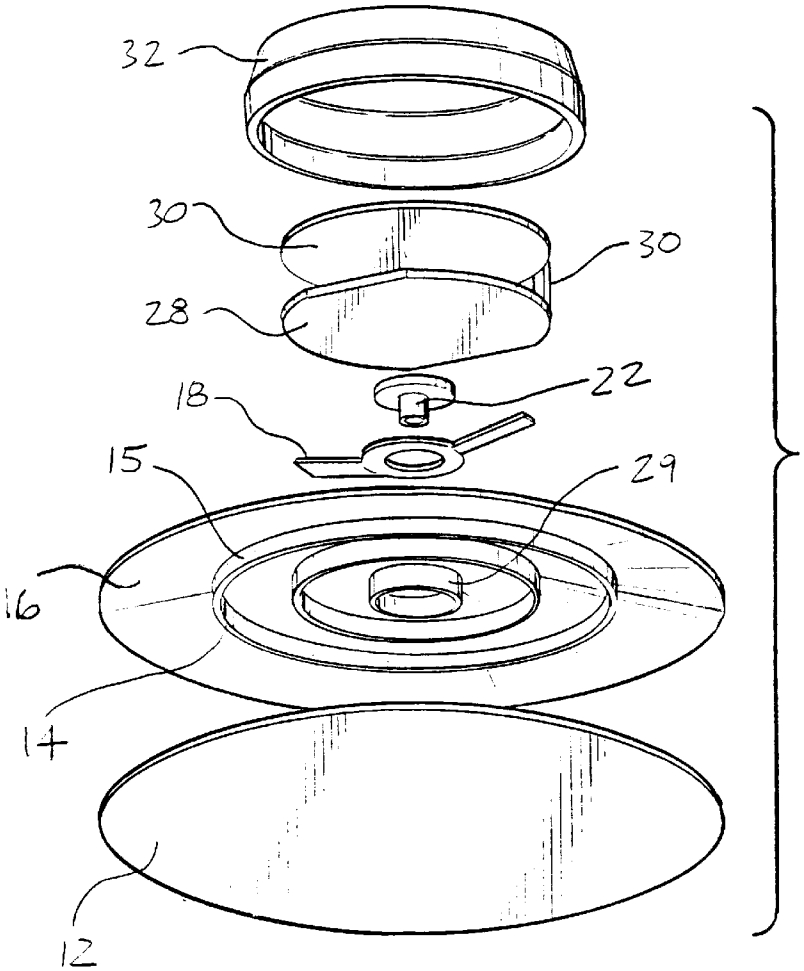
FIG. 2 is an exploded view of the embodiment of FIG. 1 viewed from below.
Figure 1:
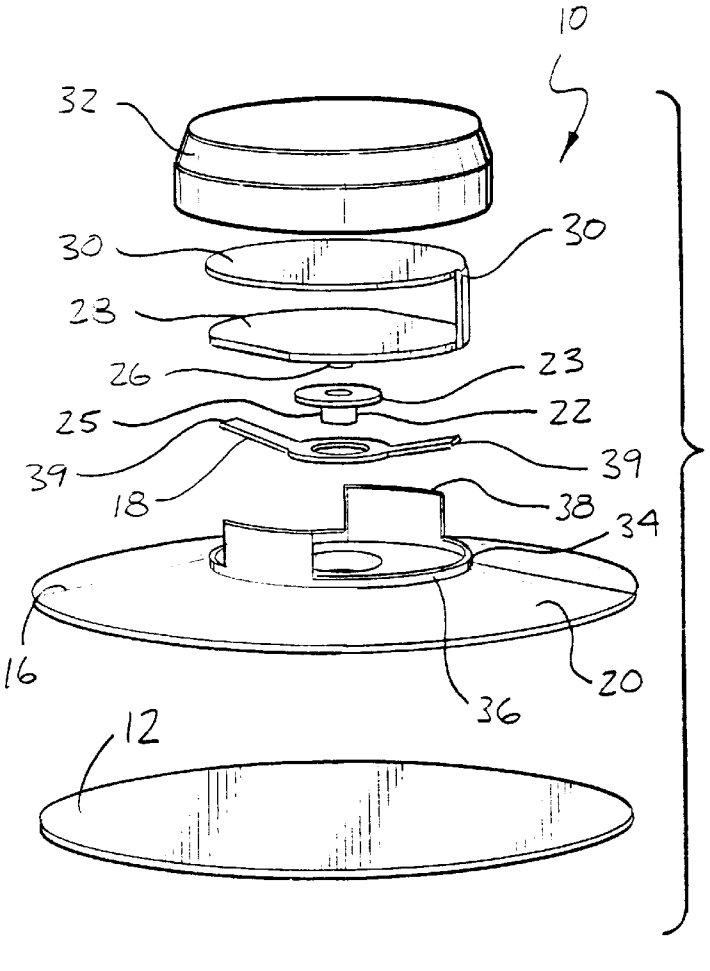
FIG. 1 is an exploded, perspective view of a first embodiment of a closure member and vacuum switch according to the present invention.

FIG. 1 discloses a first embodiment of vacuum activated switch 10 usable in the present invention. A flexible or semirigid membrane 12 is bonded to the underside 14 (seen in FIG. 2) of a container closure 16. The underside 14 of closure 16 may be provided with a plurality of concentric ridges 15 to help prevent the membrane 12 from being pierced. The membrane 12 may be an elastomer, such as a thermoplastic elastomer, and may be a simple flat sheet. In the alternate embodiment shown in FIG. 4, a convoluted bellows 50 may be employed. This bellows may be made of a suitable elastomer or a semirigid plastic such as polyethylene. The outside diameter of either embodiment determines, in part, the flexibility, as well as the amount of displacement achieved at a given pressure differential. In the case of the bellows 50, a small outside diameter results in a larger displacement than is the case with the simple flat membrane 12 depicted in FIGS. 1 and 2.

Referring back to FIG. 1, a winged contact 18 rests on a top surface 20 of container closure 18. A traveling contact 22 rests, in turn, on winged contact 18. Shank 25 includes a flat head 23 and a shank 25 which extends through an aperture 24 formed through container closure 16 and rests directly on the membrane 12. A fixed contact 26 is attached rigidly to integrated circuit board 28. The circuit board 28, in addition to an integrated circuit chip, also includes batteries (not shown). Attached to the circuit board 28 is a speaker 30. The circuit board is wired to generate a series of electrical signals to produce notes from the speaker in the form of a preselected melody or other sound or series of sounds. A cover 32 encloses and protects the various components of the circuit board and switch.

The winged contact 18 is retained in place by a retaining ring 34 disposed on the top surface 20 of closure member 16. A pair of opposed notches 36 are formed in the retaining ring 34, and the ends 39 of the wing clip 18 are retained in the notches 36. Alternately, the winged contact may be soldered to appropriate points on the circuit board. Additionally, a pair of opposed walls 38 are also formed on container closure 16 and serve to space the circuit board 28 from the closure member 16 and the diaphragm 12.

Preferably, the winged contact presents a non-level contact area to the flat head 23 of the traveling contact 22. Since the traveling contact 22 rests on membrane 12, it will move downward with membrane 12. That is, flat head 23, when in contact with the non-level winged contact surface, will be oriented at an angle with respect to the horizonal. Accordingly, the shank 25 will be tilted and make contact with the stationary contact 26, when a vacuum is applied to membrane 12, thereby completing a circuit. In the depicted embodiment, the closing of the circuit will cause the speakers 30 to emit a recorded sound, such as a melody or humorous message. However, in various alternative embodiments, the integrated circuit chip may be programmed to initiate some other activity, such as activating a light connected to the circuit board, moving a lightweight object, or releasing mechanical motion in a windup toy.

Figure 3B:
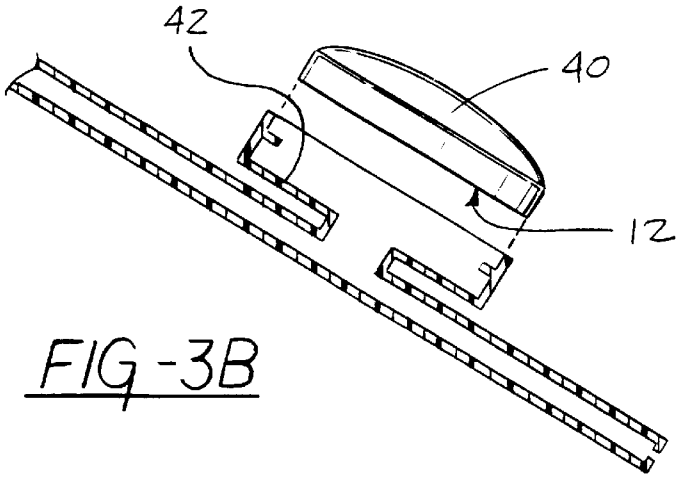
FIGS. 3*a* and 3*b* are side views of the embodiment of FIG. 1 with the various components assembled together in FIG. 3*a,* and the music module thereof removed in FIG. 3*b;*
Figure 3A:
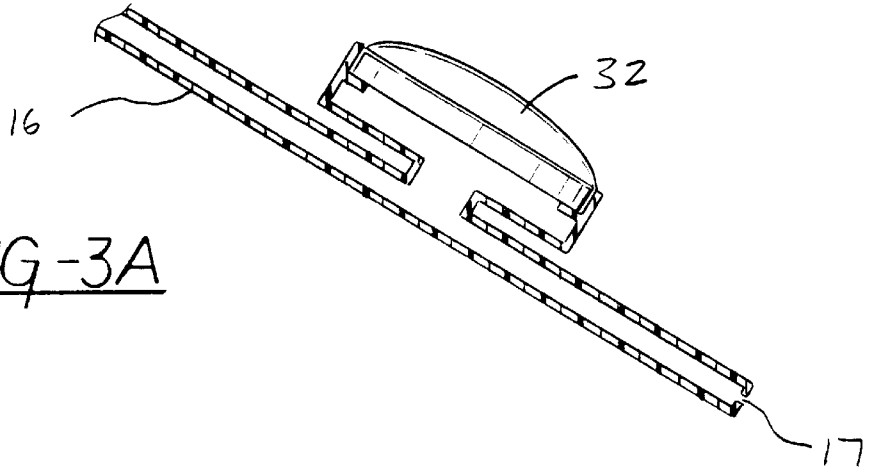

A small aperture 17 through the closure member 16 may be needed to replenish the air in the container between sippings. The size of the aperture may be determined by the amount of vacuum needed to activate the membrane 12 during sipping. FIG. 3*a* depicts the components shown in the exploded views of FIGS. 1 and 2 assembled together. FIG. 3*b* illustrates the modular construction of one embodiment of the present invention, with the music module 40, which includes the diaphragm 12, contacts 22 and 26, circuit board 28 and speaker 30, as well as the batteries. These components are covered with the cover 32 as described previously. In this embodiment, container closure 16 is molded with an opening 42 into which music module 40 is inserted. In this way, the music module 40 may be easily removed for cleaning.

Figure 4:
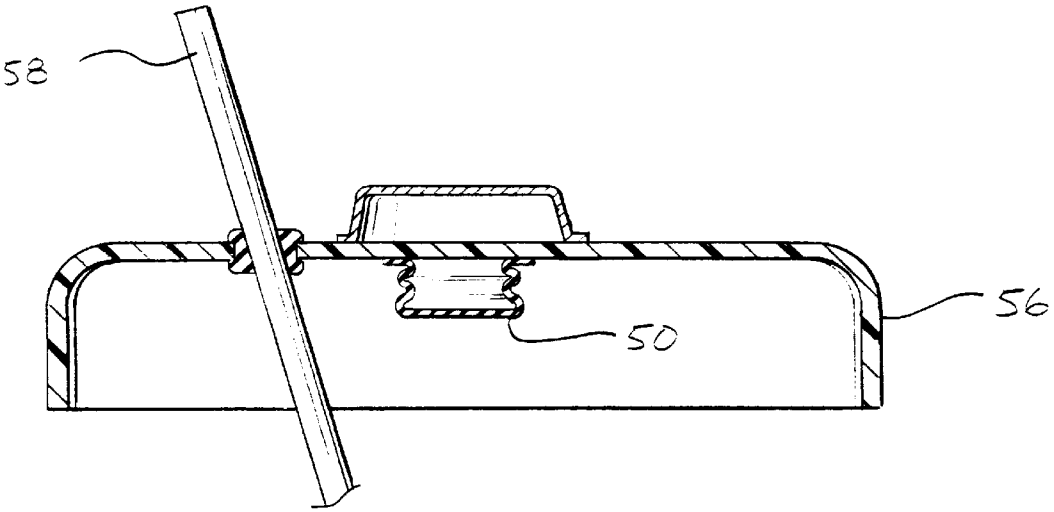
FIG. 4 is a partial cross-sectional view of a second embodiment of a closure member and vacuum switch according to the present invention.

The FIG. 4 embodiment, in addition to showing the use of the bellows 50, also illustrates a molded, dome cap 56 which serves as the container closure. A straw 58 extends through the cap 56. Preferably, a flexible seal 60 surrounds straw 58 to inhibit the leakage of air into the container.

Figure 5:
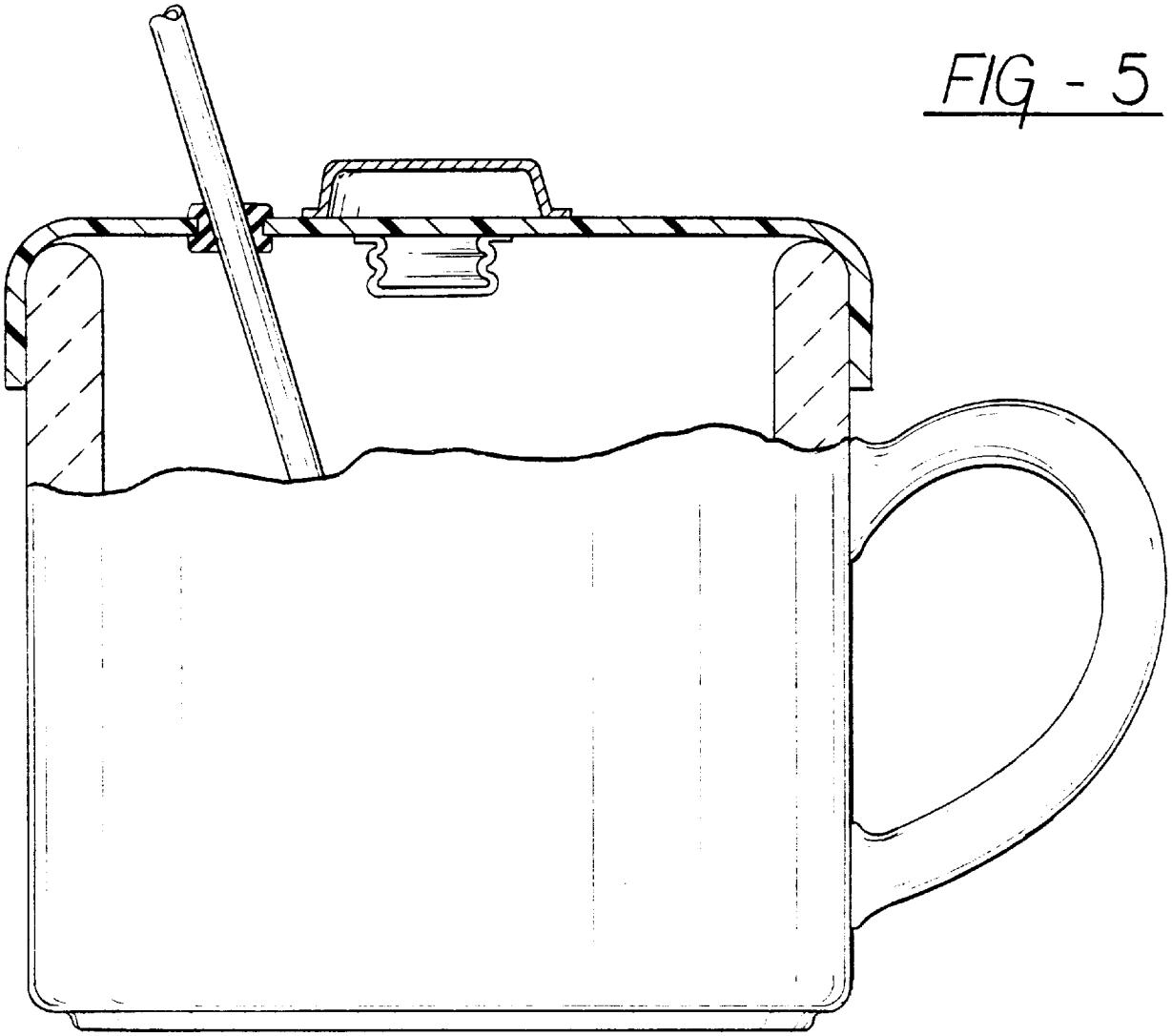
FIG. 5 shows the embodiment of FIG. 4 attached to a container.

In FIG. 5, the cap 56 of the FIG. 4 embodiment has been inserted onto a container 54. Container 54 and cap 56 are in sealing engagement (either by way of a pressure or screw fit) in order to inhibit leakage of air into the container 54. Thus, suction on straw 58 will cause a partial vacuum in the container 54, causing movement of the bellows 50 and activation of the switch 10 in the same manner as described for the FIG. 1 embodiment.

In yet another embodiment, the straight section of a straw and switch components could be made in the form of a T-fitting insertable into a standard container. The T-fitting has a cross member containing a plenum, switch and sound module as previously described.

What has been described herein is a vacuum activated switch for use in or with a container provided with a drinking straw. The switch includes a fixed contact and a traveling contact which moves in response to movement of a flexible membrane. Suction on the drinking straw causes a partial vacuum, thereby deflecting the membrane and causing the traveling contact to come into electrical contact with the fixed contact. This completes a circuit, causing the initiation of a preprogrammed action, such as the playing of a tune or other sound, the flashing of lights, or a mechanical movement.

The present invention has been described with reference to certain embodiments and exemplifications thereof. However, by referring to the teachings of the present disclosure, certain design variations may occur to one of skill in the art without departing from the scope of the present invention. For example, the container depicted could be molded in any number of shapes and sizes. Furthermore, the flexible membrane may have a different configuration than the two embodiments depicted. Such variations in design are considered to be within the scope of the present invention. Thus, it is the claims appended hereto, as well as reasonable equivalents thereof, rather than the exact depicted embodiments and exemplifications, which define the true scope of the present invention.

We claim:

1. A vacuum activated switch for use with a drinking container and straw, said switch comprising:

a closure member having an aperture formed therethrough;

a flexible or semi-rigid membrane bonded to an underside of the closure member;

a moving electrical contact extending through said aperture and resting on an upper surface of said membrane;

an integrated circuit board disposed on said closure member and spaced therefrom; and a fixed contact member in intermediate contact with said traveling contact member and rigidly mounted on said integrated circuit board, wherein deflection of said flexible membrane caused by the application of a vacuum thereto will cause said traveling contact member to make electrical contact with said fixed contact member, thereby completing an electrical circuit and initiating a predetermined action.

2. The switch of claim 1 wherein the membrane is a flat membrane.

3. The switch of claim 2 wherein the flat membrane is provided with a plurality of concentric rings for structural reinforcement.

4. The switch of claim 1 wherein the membrane is configured as an accordion pleated bellows.

5. The switch of claim 1 wherein the moving electrical contact further includes a shank extending through the container closure aperture, and a flat head.

6. The switch of claim 5 wherein deflection of the flexible membrane causes the flat head of the traveling contact member to make electrical contact with the fixed circuit member.

7. The switch of claim 1 further including a retaining ring disposed on a top surface of the closure member and a winged contact disposed in the retaining ring, said traveling contact being disposed on the winged contact and oriented eccentrically with respect to the horizontal.

8. The switch of claim 7 wherein said retaining ring includes a pair of opposed notches and the wing clip includes a pair of opposed ends which are retained respectively in the notches.

9. The switch of claim 1 further including a speaker in electrical communication with the integrated circuit board, wherein said predetermined action is acoustic.

10. A container in combination with a container cover and a straw extending through said cover, said container cover comprising:

an aperture formed through said container cover;

a flexible or semi-rigid membrane bonded to an underside of the container cover;

a moving electrical contact extending through said aperture and resting on an upper surface of said membrane;

an integrated circuit board disposed on said container cover and spaced therefrom; and a fixed contact member in intermediate contact with said traveling contact member and rigidly mounted on said integrated circuit board, wherein deflection of said flexible membrane caused by the suction on said straw will cause said traveling contact member to make electrical contact with said fixed contact member, thereby completing an electrical circuit and initiating a predetermined action.

11. The combination of claim 10 wherein the membrane is a flat membrane.

12. The combination of claim 11 wherein the container closure is provided with a plurality of concentric rings for structural reinforcement.

13. The combination of claim 10 wherein the membrane is configured as an accordion pleated bellows.

14. The combination of claim 10 wherein the moving electrical contact further includes a shank extending through the container closure aperture, and a flat head.

15. The combination of claim 14 wherein deflection of the flexible membrane causes the flat head of the traveling contact member to make electrical contact with the fixed circuit member.

16. The combination of claim 10 further including a retaining ring disposed on a top surface of the closure member and a winged contact disposed in the retaining ring, said traveling contact being disposed on the winged contact and oriented eccentrically with respect to the horizontal.

17. The combination of claim 16 wherein said retaining ring includes a pair of opposed notches and the wing clip includes a pair of opposed ends which are retained respectively in the notches.

18. The combination of claim 10 further including a speaker in electrical communication with the integrated circuit board, wherein said predetermined action is acoustic.

* * * * *